US009757743B2

(12) United States Patent
Kah, Jr. et al.

(10) Patent No.: US 9,757,743 B2
(45) **Date of Patent: *Sep. 12, 2017**

(54) WATER ROTATABLE DISTRIBUTOR FOR STREAM ROTARY SPRINKLERS

(71) Applicants: Carl L. C. Kah, Jr., North Palm Beach, FL (US); Carl L. C. Kah, III, North Palm Beach, FL (US)

(72) Inventors: Carl L. C. Kah, Jr., North Palm Beach, FL (US); Carl L. C. Kah, III, North Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/826,714

(22) Filed: Mar. 14, 2013

(65) Prior Publication Data

US 2014/0339334 A1 Nov. 20, 2014

Related U.S. Application Data

(63) Continuation of application No. 13/662,536, filed on Oct. 28, 2012, now Pat. No. 9,387,496.

(60) Provisional application No. 61/707,399, filed on Sep. 28, 2012, provisional application No. 61/552,153, filed on Oct. 27, 2011.

(51) Int. Cl.

| | |
|---|---|
| ***B05B 15/10*** | (2006.01) |
| ***B05B 3/06*** | (2006.01) |
| ***B05B 3/02*** | (2006.01) |
| ***B05B 3/00*** | (2006.01) |
| *B05B 3/04* | (2006.01) |

(52) U.S. Cl.

CPC ..... *B05B 3/063* (2013.01); *B05B 3/005* (2013.01); *B05B 3/02* (2013.01); *B05B 3/021* (2013.01); *B05B 3/0486* (2013.01); *B05B 3/0409* (2013.01)

(58) Field of Classification Search

CPC ..... B05B 3/409; B05B 3/003; B05B 3/0486; B05B 15/10; B05B 3/0409

USPC ..... 239/252, 222.15, 222.11, 222.19, 230, 239/518, 523, 505, 498; 169/37

See application file for complete search history.

(56) References Cited

U.S. PATENT DOCUMENTS

| | | | | |
|---|---|---|---|---|
| 4,471,908 | A * | 9/1984 | Hunter | B05B 15/10 239/11 |
| 4,754,925 | A * | 7/1988 | Rubinstein | B05B 15/10 239/204 |
| 4,944,456 | A * | 7/1990 | Zakai | B05B 3/0404 239/222.19 |
| 4,967,961 | A * | 11/1990 | Hunter | A62C 37/10 239/240 |

(Continued)

*Primary Examiner* — Arthur O Hall
*Assistant Examiner* — Joseph A Greenlund
(74) *Attorney, Agent, or Firm* — Ostrolenk Faber LLP

(57) ABSTRACT

A rotating distributor for use in a rotary type sprinkler is conically shaped and includes a plurality of water channels provided on a bottom surface thereof to guide water from a center axis of the distributor radially outward to an outer circumference of the distributor. The grooves are provided to collect and guide the water with a minimum of spray and turbulence and to impart rotation on the distributor. The depth of the grooves may be used to control flow and range as desired. An elevation control ring may be provided to vary the elevation angle of water leaving the grooves to control range. A kick angle control element may be provided to modify a kick angle at an outer circumferential end of selected grooves to provide speed control, if desired.

2 Claims, 10 Drawing Sheets

(56) References Cited

U.S. PATENT DOCUMENTS

| | | | | | |
|---|---|---|---|---|---|
| 5,620,141 | A * | 4/1997 | Chiang | B05B 3/0422 | 239/206 |
| 5,671,886 | A * | 9/1997 | Sesser | B05B 3/005 | 239/222.21 |
| 5,718,381 | A * | 2/1998 | Katzer | B05B 3/003 | 239/204 |
| D615,152 | S * | 5/2010 | Kah, Jr. | B05B 3/0486 | D23/214 |
| 8,074,897 | B2 * | 12/2011 | Hunnicutt | B05B 3/003 | 239/204 |
| 8,602,325 | B2 * | 12/2013 | Clark | B05B 3/0422 | 239/206 |
| 8,925,837 | B2 * | 1/2015 | Walker | B05B 1/304 | 239/224 |
| 2002/0139868 | A1 * | 10/2002 | Sesser | B05B 1/262 | 239/457 |
| 2006/0108445 | A1 * | 5/2006 | Pinch | B05B 3/005 | 239/222.21 |
| 2008/0087743 | A1 * | 4/2008 | Govrin | B05B 3/0468 | 239/214.13 |
| 2010/0301135 | A1 * | 12/2010 | Hunnicutt | B05B 1/304 | 239/222.17 |
| 2011/0139896 | A1 * | 6/2011 | Drechsel | B05B 3/003 | 239/214 |
| 2013/0105596 | A1 * | 5/2013 | Kah, III | B05B 3/021 | 239/222.13 |
| 2014/0110501 | A1 * | 4/2014 | Lawyer | B05B 3/003 | 239/222.17 |

* cited by examiner

WATER ROTATABLE DISTRIBUTOR FOR STREAM ROTARY SPRINKLERS

CROSS-REFERENCE TO RELATED APPLICATIONS

The present application claims benefit of and priority to U.S. Provisional Patent Application Ser. No. 61/707,399 filed Sep. 28, 2012, entitled WATER ROTATABLE DISTRIBUTOR FOR STREAM ROTARY SPRINKLERS and U.S. patent application Ser. No. 13/662,536 filed Oct. 28, 2012 entitled APPARATUS FOR MAINTAINING CONSTANT SPEED IN A VISCOUS DAMPED ROTARY NOZZLE SPRINKLER which claims benefit of and priority to U.S. Provisional Patent Application Ser. No. 61/552,153 filed Oct. 27, 2011 entitled VISCOUS DAMPER ROTARY NOZZLE SPEED CONTROL, the entire content of each of which is hereby incorporated by reference herein.

BACKGROUND

Field of the Disclosure

The present disclosure relates to irrigation sprinklers in which water is distributed outwardly from the sprinkler by a rotating, self-driven, distributor with water exiting from multiple channels in the rotating distributor. In order to achieve the desired water distribution both in range and arc of coverage, various rotating distributor stream channel configurations may be used. The channel configuration also affects the speed of rotation as the range or arc of coverage is changed by adjustments made to the sprinkler nozzle assembly.

The speed of rotation of the distributor may be controlled using vicious damping, friction breaking, centrifugal force activated braking, or high flow rate speed limiting.

Related Art

Previously filed patent applications for sprinklers that include arc and range of coverage adjustment that are suitable for use with the rotating distributor disclosed herein include U.S. patent application Ser. No. 11/947,571 filed Nov. 29, 2007 entitled Sprinkler Head Nozzle Assembly with Adjustable Arc Flow Rate and Stream Angle which claims priority to U.S. Provisional Patent Application Ser. No. 60/912,836 filed Apr. 19, 2007 entitled Adjustable Arc Flow Rate and Stream Angle Viscous Damped Rotary Low Flow Rate Fully Adjustable Sprinkler Nozzles and U.S. patent application Ser. No. 12/348,864, filed Jan. 5, 2009 entitled Arc And Ranged Of Coverage Adjustable Stream Rotor Sprinkler which claims priority to U.S. Provisional Patent Application Ser. No. 61/018,833 filed Jan. 3, 2008 entitled Arc and Range of Coverage Adjustable Stream Rotor Sprinkler, the entire content of each of which is hereby incorporated by reference herein.

SUMMARY

Several groove or channel configurations for a rotating distributor are shown and described in the present disclosure that provide improved performance when mounted on a shaft for rotation above an arcuate adjustable length circumferential water nozzle slot with upstream range of coverage flow control.

The sprinkler nozzle body assemblies may include both upstream flow throttling to the arcuate nozzle for range control and arc of coverage adjustment. Since the rotating distributor is self driven by the reaction force of the water against the stream channel surfaces, the speed of rotation is affected by the channel configuration and the characteristics of the speed brake, which is preferably a viscous brake in configurations shown herein, that allow for manual adjustment of the arc of coverage and range of coverage on the sprinkler nozzle assembly housing.

Reduction of the flow striking the rotating distributor, either due to the reduction of the arc of coverage around the sprinkler, or reduction of the flow and/or velocity striking the rotating distributor to provide reduced range of coverage, also reduces the rotating driving force on the self propelled rotating distributor and results in a speed reduction. This speed reduction is typically approximately proportional to the reduction of flow. Similarly, speed increase is normally approximately proportional to the increase of flow and nozzle exit velocity striking the deflector.

It is desirable that the rotating distributor rotates within a selected range of speeds from perhaps as slow as ¼ RPM to about 15 RPM, however, customers may prefer to see sprinklers of all the different ranges and arcs of coverage that rotate at least at somewhat similar speeds, such as a range of 1 to 15 RPM.

Several different ways to provide rotating distributor plate water channel groove configurations are shown. The channels collect the sprinkler's nozzle flow which strikes the under side of the rotating distributor plate and flows into the channels where it is conveyed to the outer circumference of the distributor and discharged from the rotating distributor.

In an embodiment, the channels are preferably almost axial at the inner radial water entrance of the channel and slightly offset from the rotational center of the distributor so that the sprinkler nozzle flow is captured in the desired proportions in each of the channels with a minimum of splash and flow velocity turbulence due to the slightly displaced channel entrance. This provides some rotational turning force against each channel in the rotation direction leading wall as the flow continues its upward and the radial outward path along the conical center surface of the distributor.

The slight radial offset of the entrance of these channels makes it possible to provide more flow in some channels, not only by making them wider or deeper but also by reducing the height of the channels drive wall so that some of the sprinkler nozzle flow i.e. from the 0.026 inch nozzle flow slot width and less high channel slot walls to capture more of the flow into the proceeding selected channels against the selected channel vertical axial drive and flow capture sidewall. The ability to provide more flow in some channels is another way of increasing the range of coverage. Providing different stream exit elevation angles also affects range.

This feature is important since in air, the outward throw range from the sprinkler is determined by the exit stream elevation angle from the rotating deflector, or distributor, as well as the momentum of the stream vs. the surface area that is exposed to air drag and sheering as the water travels outwardly from the sprinkler.

Another improved feature is the use of only a partial stream kick angle element positioned toward the outside circumference of the rotating distributor stream channels to provide the desired turning rotational torque, but as the flow rate increases in the channels, the rotational torque does not further increase, since it fills the channel out passed where the kick angle surface has been discontinued.

Thus, when the upstream flow valve has reduced the flow velocity and flow rate to the rotating distributor in order to shorten the range of coverage out from the sprinkler, the lower flow rate which has piled water up against the channel lead capture wall is directed against the short, more lightly angled kick angle surface to provide desired rotational driving force.

However, when the upstream throttling valve is open for full flow and higher velocity from the sprinkler nozzle, the rotational speed of the rotating distributor does not speed up as much as a conventionally designed passage since the kick angle surface of the channel does not extend entirely across the channels as the increased flow fills the channels and bypasses the partial kick angle and is directed more radially outward enhancing the range increase and producing less increase in drive force for increasing the speed of rotation.

This is another important feature since it allows greater range of coverage adjustment with less effect on the speed of the rotation of the rotating distributor.

For the flow channel designs disclosed, it is very easy to achieve the desired range, arc of coverage and water distribution around the sprinkler to provide improved uniform irrigation and allow minimum use of water.

Also disclosed is a rotationally selectable axial ring around the outside surface of the rotating distributor so that a deflection surface may be selectively moved up or down on top of the higher exit elevation streams to increase or decrease the range of coverage by changing the stream exit elevation angle while maintaining the high flow rate to allow for providing a higher precipitation rate over a shorter range of coverage.

In another configuration, a ring around the outside circumference of the rotating distributor is provided that does not adjust axially into the stream, but is rotationally attached so that the kick angle surfaces or vanes may be rotated into selected exit streams to increase rotation at reduced flow conditions or increase the velocity of rotation at normal flow rates which may be very low for some sprinkler types at their low arc setting or special coverage area sprinklers as for shapes, i.e. side strips, end strip or extra short ranges of 6 feet etc.

A rotating distributor for use in a rotary nozzle sprinkler in accordance with an embodiment of the present disclosure includes a conical body and a plurality of grooves formed in a bottom surface of the conical body, each groove of the plurality of grooves extending from an inlet end thereof positioned adjacent to a center of the conical body to an outlet end thereof positioned adjacent to an outer periphery thereof, such that the outlet end of each channel has the same non-radial exit angle.

A rotating distributor for use in a rotary nozzle sprinkler in accordance with another embodiment of the present disclosure includes a conical body; and a plurality of grooves formed in a bottom surface of the conical body, each groove of the plurality of grooves extending from an inlet end thereof positioned adjacent to a center of the conical body to an outlet end thereof positioned adjacent to an outer periphery thereof.

A rotating distributor for use in a rotary nozzle sprinkler in accordance with an embodiment of the present disclosure includes a conical body; and a plurality of grooves formed in a bottom surface of the conical body, each groove of the plurality of grooves extending from an inlet end thereof positioned adjacent to a center of the conical body to an outlet end thereof positioned adjacent to an outer periphery thereof; and a deflection adjustment ring mounted on the conical body including at least one kick vane extending inwardly into at least one groove of the plurality of grooves, the deflection adjustment ring movable from a first position wherein the kick vane extends into the groove and a second position wherein the kick vane is retracted out of the groove.

DETAILED DESCRIPTION OF THE EMBODIMENTS

Figure 1:
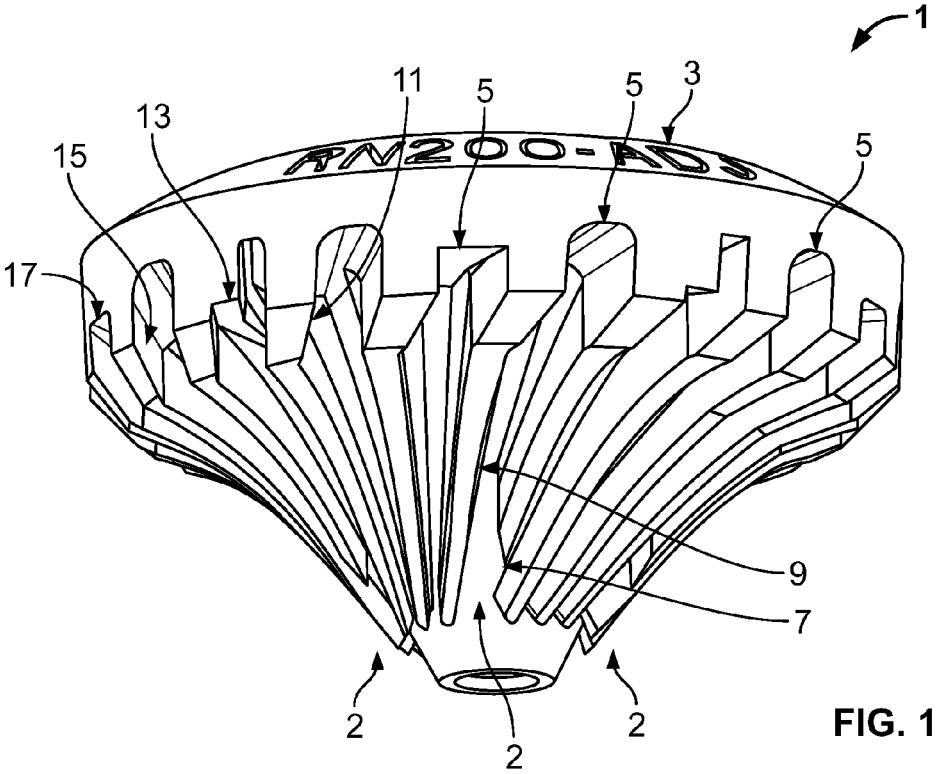
FIG. 1 is a perspective elevation view of a rotating distributor rotor where all of the water collection channel grooves are slightly offset from center and have the same exit angle and different stream exit elevation angles. Different stream exit elevation angles and different slot widths and flow rates provide desired coverage around the sprinkler.

FIG. 1 illustrates an exemplary embodiment of a rotating distributor 1 in accordance with an embodiment of the present application. The distributor 1 has a cone shaped center body, which may be hollowed out to enclose a viscous damping speed controlling brake. Alternatively, the distributor 1 may be mounted on a supporting shaft with the speed controlling braking system connected to the supporting shaft elsewhere.

Figure 7:
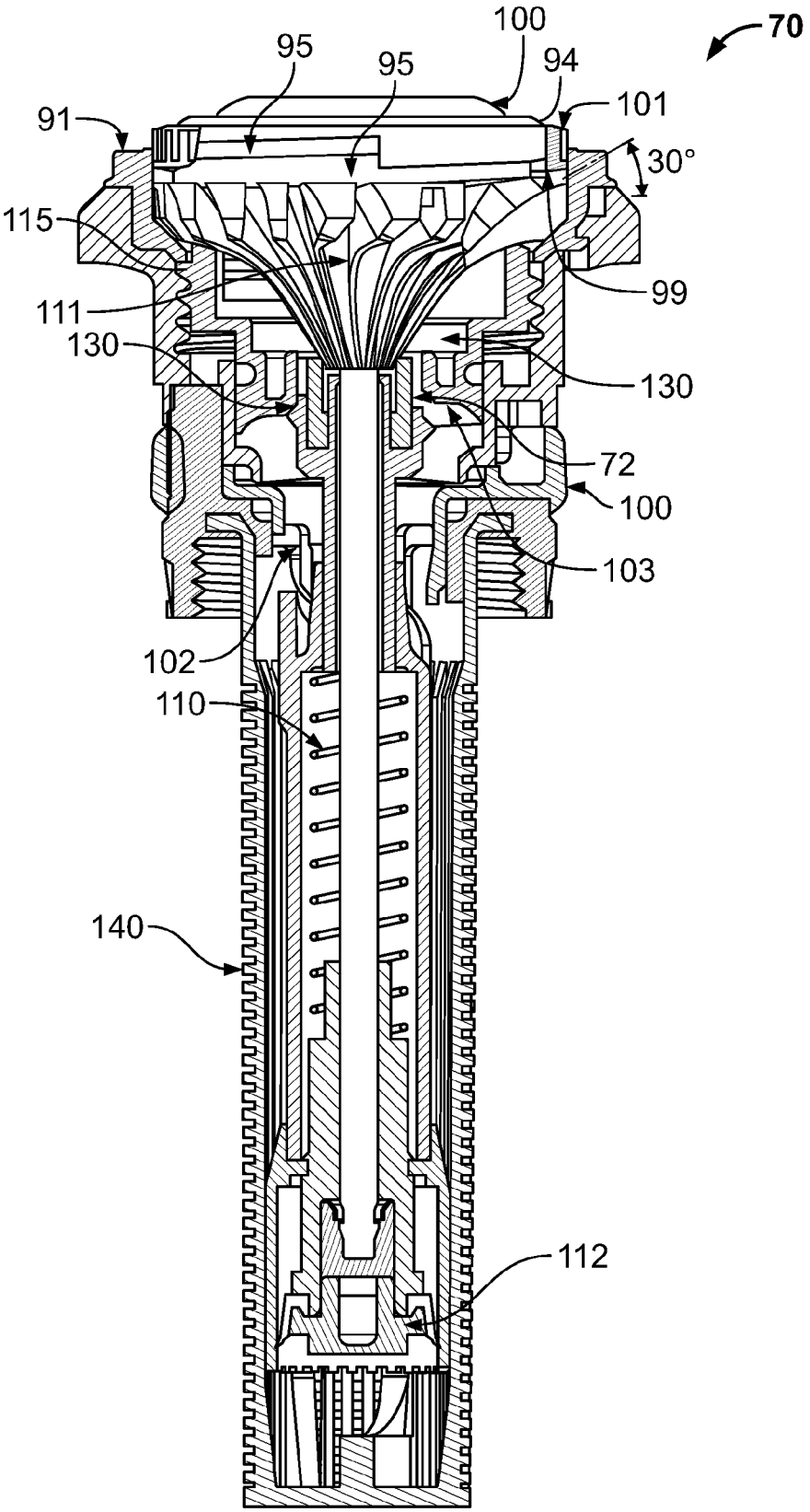
FIG. 7 is a cross section elevation view of a sprinkler nozzle assembly with a filter in which a rotating distributor is in a retracted position and includes a stream exit elevation angle deflection adjustment ring mounted around the outside circumference of the rotating distributor in the 30 degree elevation angle position. This sprinkler nozzle assembly also includes a top settable arc of coverage and separate outside ring settable range of coverage adjustment element.
Figure 9:
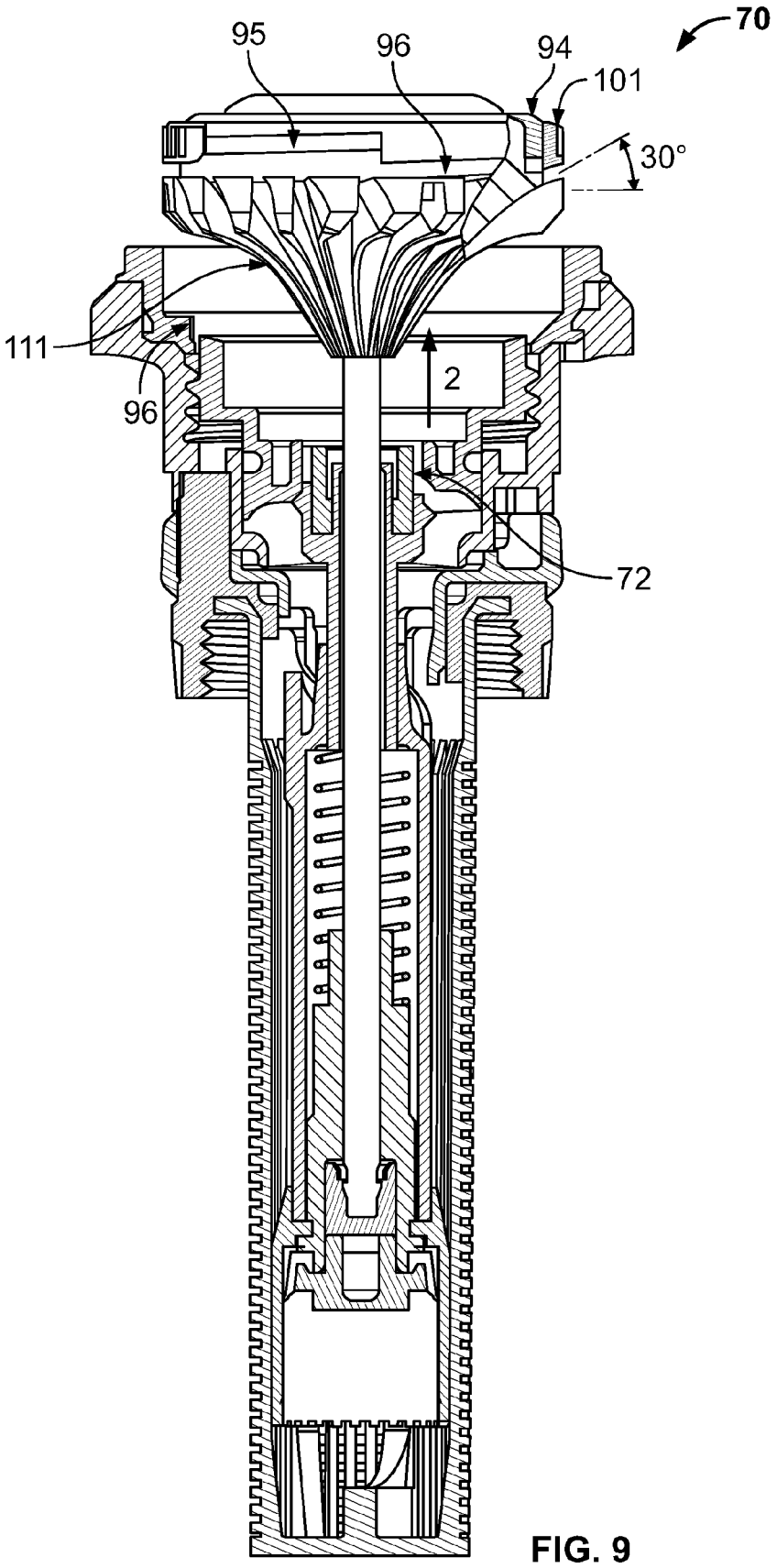
FIG. 9 is the cross sectional elevation view of the rotating distributor sprinkle nozzle of FIG. 7 shown in the extended pressurized operating position of the rotating distributor rotor with an allowable 30 degrees exit elevation angle for maximum range.
Figure 10:
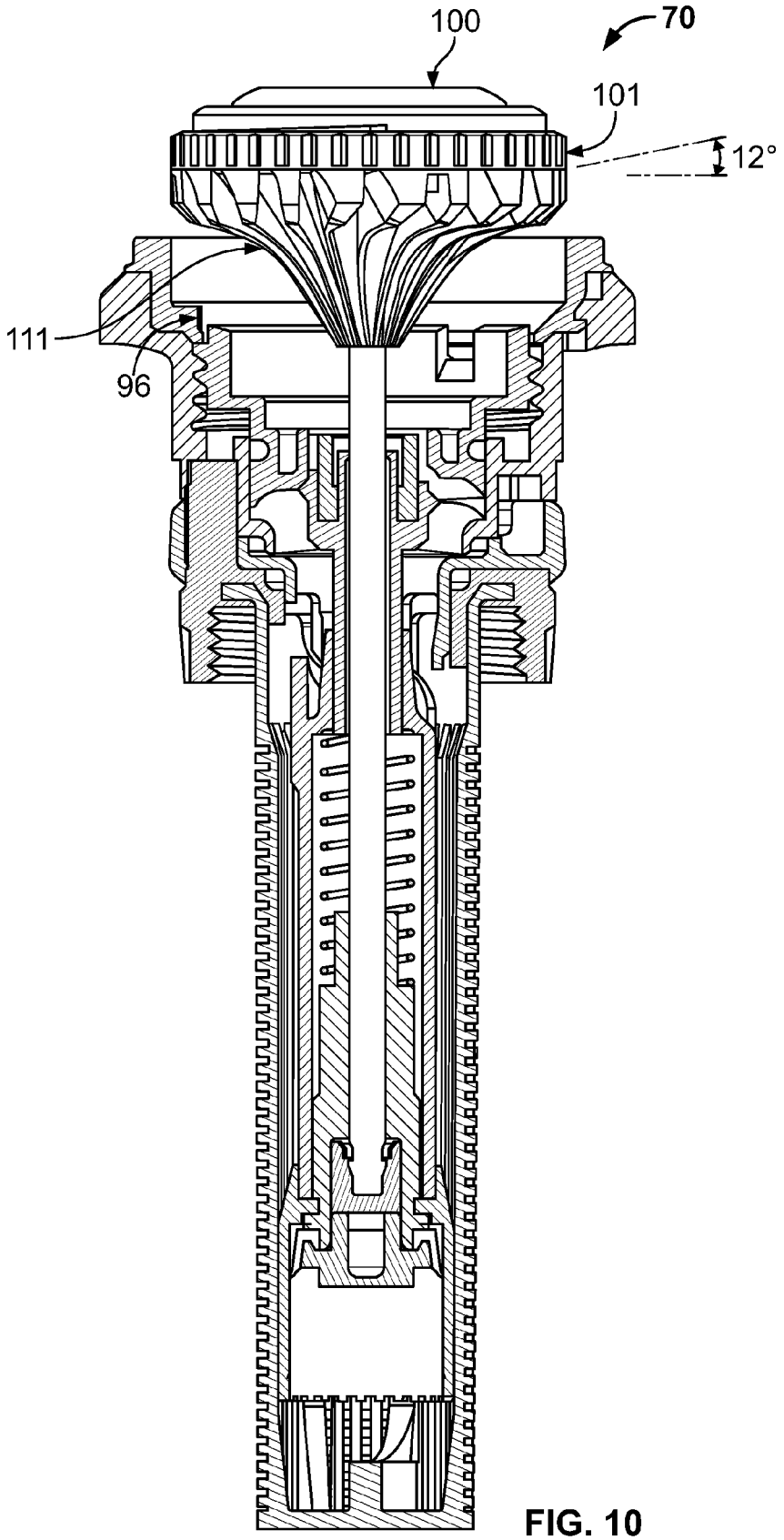
FIG. 10 is the same as FIG. 9 except with the stream elevation angle control ring set for a low stream exit elevation angle of 12 degrees and reduce range at same flow rate.

A rotating distributor 1 of the type shown in FIG. 1 is shown mounted in a sprinkler nozzle assembly in FIGS. 7, 9 and 10. The distributor 1 of the present application would also be suitable for use in the sprinkler nozzle assemblies described in co-pending U.S. patent application Ser. No. 11/947,571 filed Nov. 29, 2007 entitled Sprinkler Head Nozzle Assembly with Adjustable Arc Flow Rate and Stream Angle and Ser. No. 12/348,864, filed Jan. 5, 2009 entitled Arc And Ranged Of Coverage Adjustable Stream Rotor Sprinkler, the entire content of each of which is hereby incorporated by reference herein. The features and benefits of the rotating distributor disclosed herein are applicable to the above sprinklers and other similar types of stream rotor sprinklers.

In FIG. 1, the rotating water distributor 1 has a series of repeating channels 5 cut into its surface for collecting and channeling the water flow from the arcuate nozzle 72, see FIGS. 7 and 9, of sprinkler nozzle assembly 70. In FIG. 1, the arcuate nozzle water discharge is indicated by the arrows 2 which strike the underside of the cone shaped rotating distributor 1 near the rotational center and are collected into the selection of channels 5, as shown in FIG. 1 and plan view FIG. 2 that extend outwardly to the rotating distributor outside circumference and then radially distribute the water outwardly from and around the sprinkler housing assembly 70.

These channels 5 and the sidewalls 9, 11, provide the rotational drive for rotating the distributor 1 as well as determining the water distribution range and uniformly distribution of water outwardly and around the sprinkler.

Figure 2:
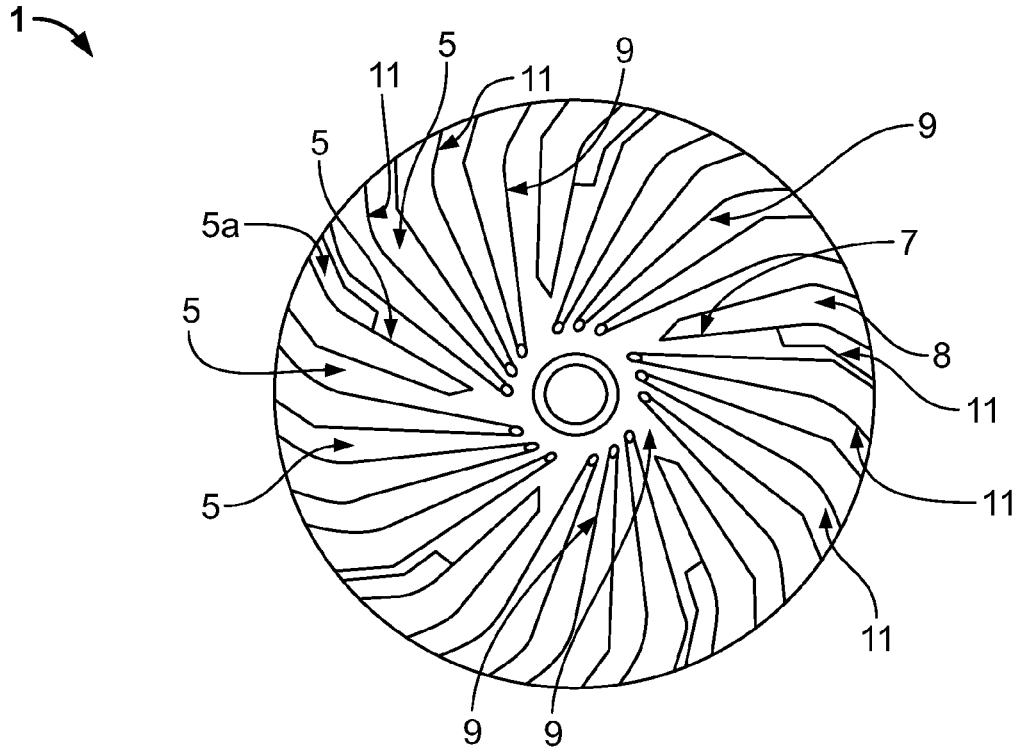
FIG. 2 is a plan view of the distributor rotor plate of FIG. 1.

The water distribution channels 5 of the rotating distributor 1 shown in FIGS. 1 and 2 all have the same propulsive water turning angle 11 at the outside circumference of the rotating distributor 1 where the turning force moment arm radius is the greatest.

This configuration is well suited for lower flow rate, shorter range sprinklers since all of the channel provides driving force.

As can be seen in FIGS. 1 and 2, the water channels 5 and channel walls 9 are slightly radially offset from the center of rotation of the distributor 1. The configuration of the channels causes the flow of water as indicated by arrow 2 to strike the underside of the distributor and to strike the slightly radial offset channel wall surfaces 9 and then be moved outward following the inner conical shaped bottom walls 5*a* of the rotating distributor 1 which is preferably at a steep angle to the axis of rotation near the center of rotation of the distributor and forms the bottom contour 5*a* of each of the channels 5. The almost axial shape of the channel walls and the steep conical surface of the bottom 5*a* of each channel 5 near the center of rotation where the water from the water from the sprinkler nozzle strikes the distributor provides a shallow incidence angle between the water stream as represented by arrows 2 and the distributor channel walls 9 and bottoms 5*a* causing a minimum loss of velocity and no flash spray. Channel walls may be shorter at selected locations such as shown at 7 in FIGS. 1 and 2 to allow more flow to fill the preceding channels.

Figure 1A:
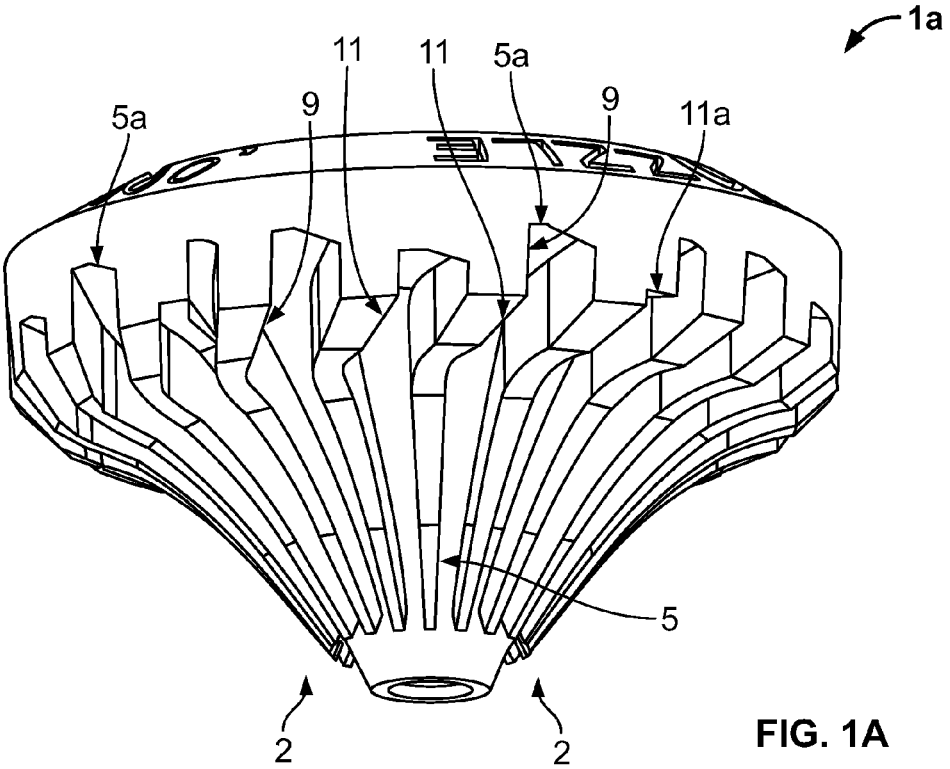
FIG. 1A is a perspective elevation view of a rotating distributor where the water collection channel grooves extend substantially radially from a center of the distributor and have the same exit angle and different stream elevation angles.
Figure 2A:
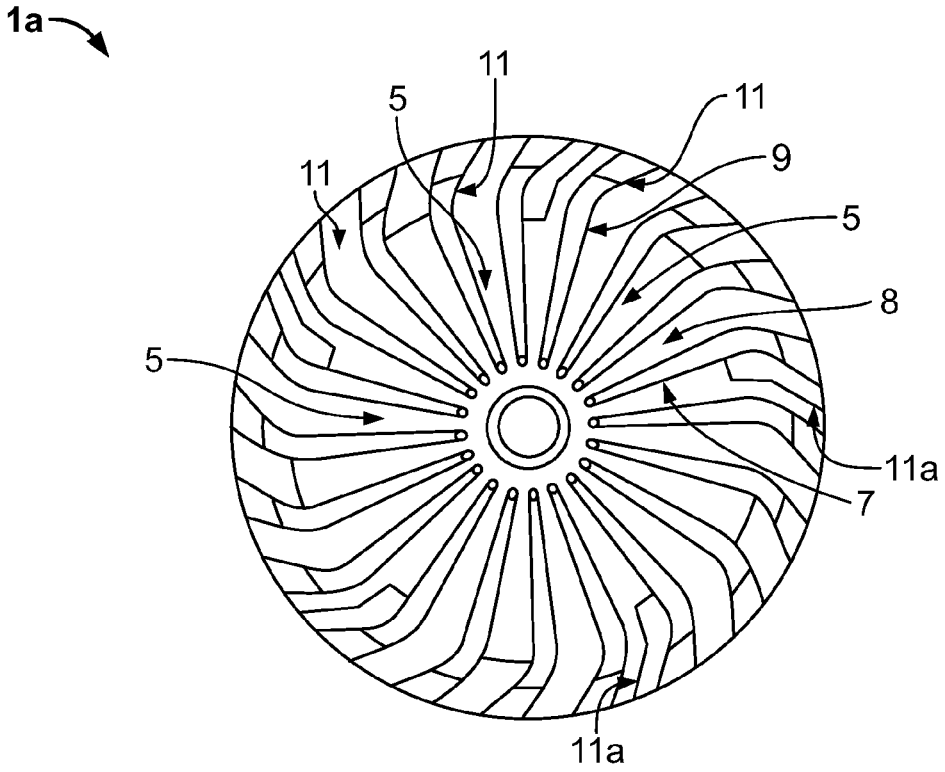
FIG. 2A is a plan view of the distributor rotor plate of FIG. 1A.

Alternatively, a distributor 1*a*, illustrated in FIGS. 1A, and 2A, may include channels 5 that extend axially and substantially radially at their inner entrance thereof to limit splash and turbulence when contacted by the water streams 2 and include angled surfaces 11 at the distal end of the channel to impart rotation against walls 9. The substantially radial portion of the channels provides good guidance for the water streams 2 and prevents jumping between channels and provides reduced turbulence in getting the flow stream of water as indicated at 2 from the nozzle assemblies adjustable arcuate slot nozzle as shown at 72 in FIGS. 7 and 9 onto the channel bottom surface 5*a* or of their rotating distributor.

Since the channel walls in the configuration of FIGS. 1-2 are slightly radially offset from the center of rotation, the flow fills the channels 5 against the rotational leading side of the channels of which should be higher and straight downward in an axial direction to accumulate the flow as it builds up or is reduced and provides the rotational driving force against water turning angle surface 11 near the outside circumference of the rotating distributor 1.

Individual channel stream elevation angles can be established by surfaces such as 17 or 13 and a flow rate in each channel can be controlled by adjusting the depth of the channel as at 7 and 8 as well as the distance between channel walls as at 7 in each channel to provide the desired precipitation outwardly from the sprinkler on the ground contacted by each of the different range and flow channel's water.

The water inlet stream 2 striking the slightly offset straight channel walls does provide some turning force, but because of its small radial lever arms, it has limited effect and the important concern is how smoothly the water inlet stream encounters the surface of the distributor and is distributed in to its channels 5. In the embodiment of FIGS. 1A and 2A, the substantially radial position of the inner portion of the channels 5*a* allows for smooth water inflow, since the channel walls are radial. A sloped bottom 5*a*, as shown in FIG. 1A causes the channel flow at start up or turn off during rotation over the arcuate water inlet nozzle to be collected toward the leading channel wall 9 to provide well defined distributor exit streams during the turn on and off.

Figure 3:
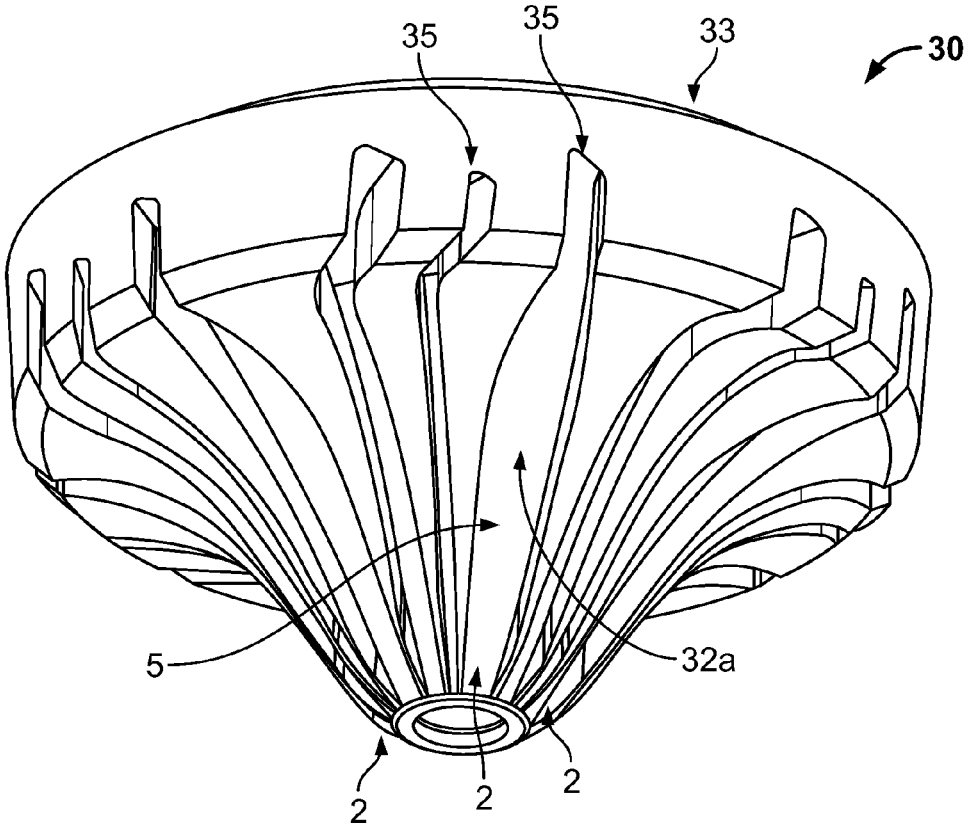
FIG. 3 is a perspective elevation view of a rotating distributor rotor where all of the channels are radial with selected channels having the same curved channel exit kick angle wall to rotationally drive the distributor and wider range channels with convergent curved side walls near their end at the outer circumference of the distributor.
Figure 4:
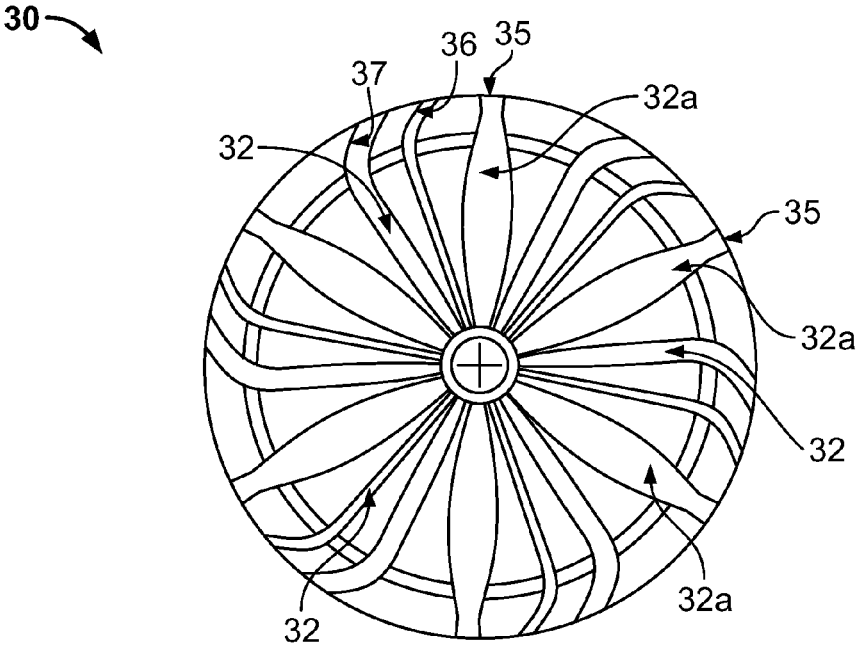
FIG. 4 is a plan view of the distributor rotor plate of FIG. 3 showing the wider flow collection end of the radial range channels with converging curved sidewalls.

The distributor configuration 30 shown in FIGS. 3 and 4 is a preferred configuration for longer range and higher flow rate sprinklers.

In this configuration, the entire channel starts out from the center of rotation substantially radially (see channel 32) and some channels continue to the outside circumference of the distributor totally radially (see channel 35) with no stream exit angle relative to the center of rotation of the distribution. Other streams which are moved toward the outside circumference of the distributor 30 by the same conical shape of the bottoms of the channels which is steepest axially at the center of rotation of the distributor then becoming more radial have their propulsive turning angle such as shown at 36 and 37 positioned near the outer radial part of the channel flow path 32 which provides a minimum channel flow path impedance and the best turning force for the deflector. Thus, the loss of stream momentum due to being turned is minimized and only applied to the channel stream at a more turning torque effective radius to retain channel stream momentum for discharging the water outwardly from the rotating distributor sprinkler nozzle housing to provide the desired water precipitation around the sprinklers nozzle assembly. It is also beneficial to widen the range channels 35 as shown in FIGS. 3 and 4 near their more radial transition 32*a* injection angle, to not only collect more flow but to thin these channels' higher flow streams to minimize turbulence during bending. These higher flow rate purely radial flow channels 32*a* may then be reconverged at the exit 35 for maximum discharge momentum and range at their design flow rates.

As discussed for distributor 1 in FIG. 1 and FIG. 2, the channel stream exit elevation angles can be controlled by step 13, for example, in the channel bottoms such as shown in FIG. 1, such that the distribution and the flow rate for each channel can be determined by the width and depth of the radial slot at the water entry near the center of the rotation as at 32.

Figure 5:
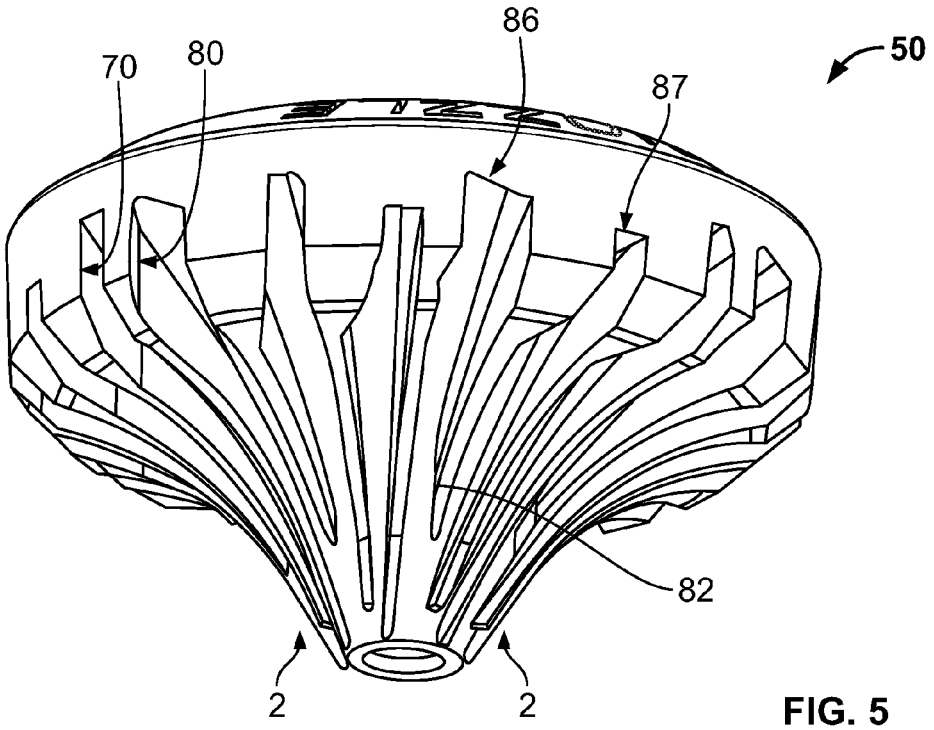
FIG. 5 is a perspective elevation view of a rotating distributor rotor where all of the water collection channel grooves have the same exit kick angle deflection surface relative to a radial center line from the center of rotation to the exit surface on the outside circumference of the rotor with different kick surface lengths to only partially deflect coverage of channel exit areas.
Figure 6:
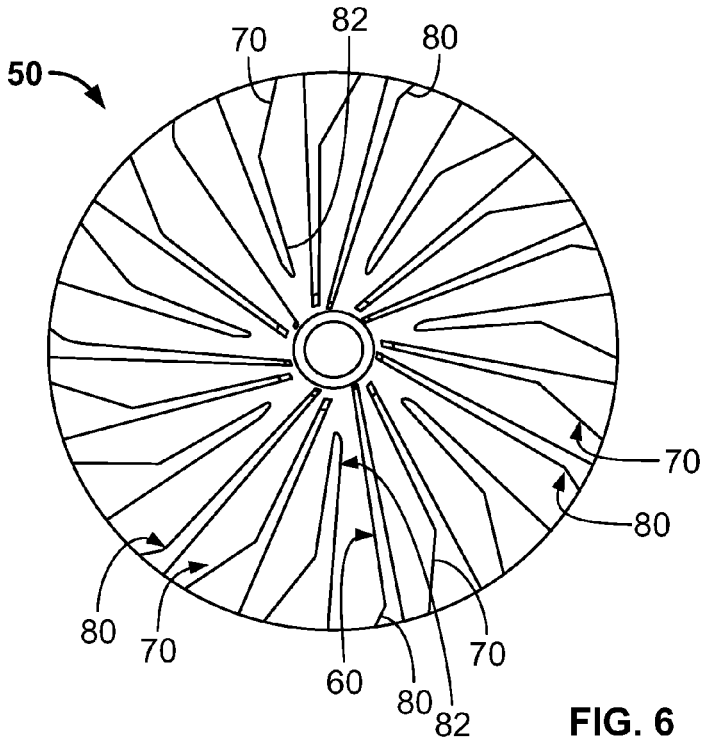
FIG. 6 is a plan view of the rotating distributor of FIG. 5.

In the rotating distributor 50 shown in FIGS. 5 and 6, a new concept is shown where all of the channels originate radially or almost radially as desired and progress outward essentially radially over the conical shaped bottom surface of the channel of the rotating distributor. Near the outside circumference, where the stream turning will produce the greatest turning torque, a kick angle element 70, 80 is provided to some or all of the channels. The kick angle elements 70, 80 preferably include the same torque producing kick angles. Some of the kick angles elements, however, start radially sooner (see element 70, for example), and others start in the radial channels further outwardly (see element 80, for example).

These channels can have different stream exit elevation angles as shown in FIG. 5 at 86 and 87 and different flow rates as adjusted by inner diameter slot widths and depths as well as shortened adjacent flow channel wall ribs 82, for example.

In the radial flow channel(s) with the shorter kick angle element 80, turning kick angles can provide an enhanced range throttling effect by being sized to provide the necessary turning force at the minimum arc of coverage with the range control upstream throttling set to a minimum. The flow rate may then be increased by the reducing the upstream throttling to allow for full flow rate, for example.

The full flow rate fills the channels such as 60 with its partial kick angle surface 80, past the kick angle surface 80 which then flows directly radially outward producing a further increase in turning force against the small kick angle element such as at 80. As shown at 82 in FIGS. 5 and 6 selected channel ribs can be shortened as per FIGS. 1 and 2 to allow more flow to be captured by adjacent channels from the accurate adjustable nozzle as shown at 2.

This provides a minimum rotational speed at the minimum flow rates striking the rotating distributor, yet as the flow rates are increased due to the increased range setting upstream flow throttling valve, shown in FIG. 7 at 102 with an outer sprinkler setting ring 100 for setting increases in the rotational speed of the rotating distributor does not increase as much or excessively.

Thus, this feature is attractive especially for high flow, longer range adjustable sprinklers.

FIG. 7 shows a cross section elevation view of rotating distributor sprinkler nozzle assembly 70 of the type that would utilize the types of rotating distributors discussed in FIG. 1 through FIG. 6 and is described in full detail in co-pending U.S. patent application Ser. Nos. 11/947,571 and 12/348,864 which were incorporated by reference herein.

Some of the basic features are pointed out here to aid in understanding the features and benefits of the rotating distributors shown in FIGS. 1 though 6. Additional features are provided in the distributors shown in FIGS. 7-14. Additional range of coverage control may be provided via adjustability of the exit elevation angle as shown in FIGS. 7 through 10. The distributors shown in FIGS. 11-14 include channel stream exit kick angle adjustability for some rotational speed control, if desired, by being able to increase the exit kick angle of selective channels for more or less turning torque to control the resulting rotational speed control of the rotating distributors.

Figure 8:
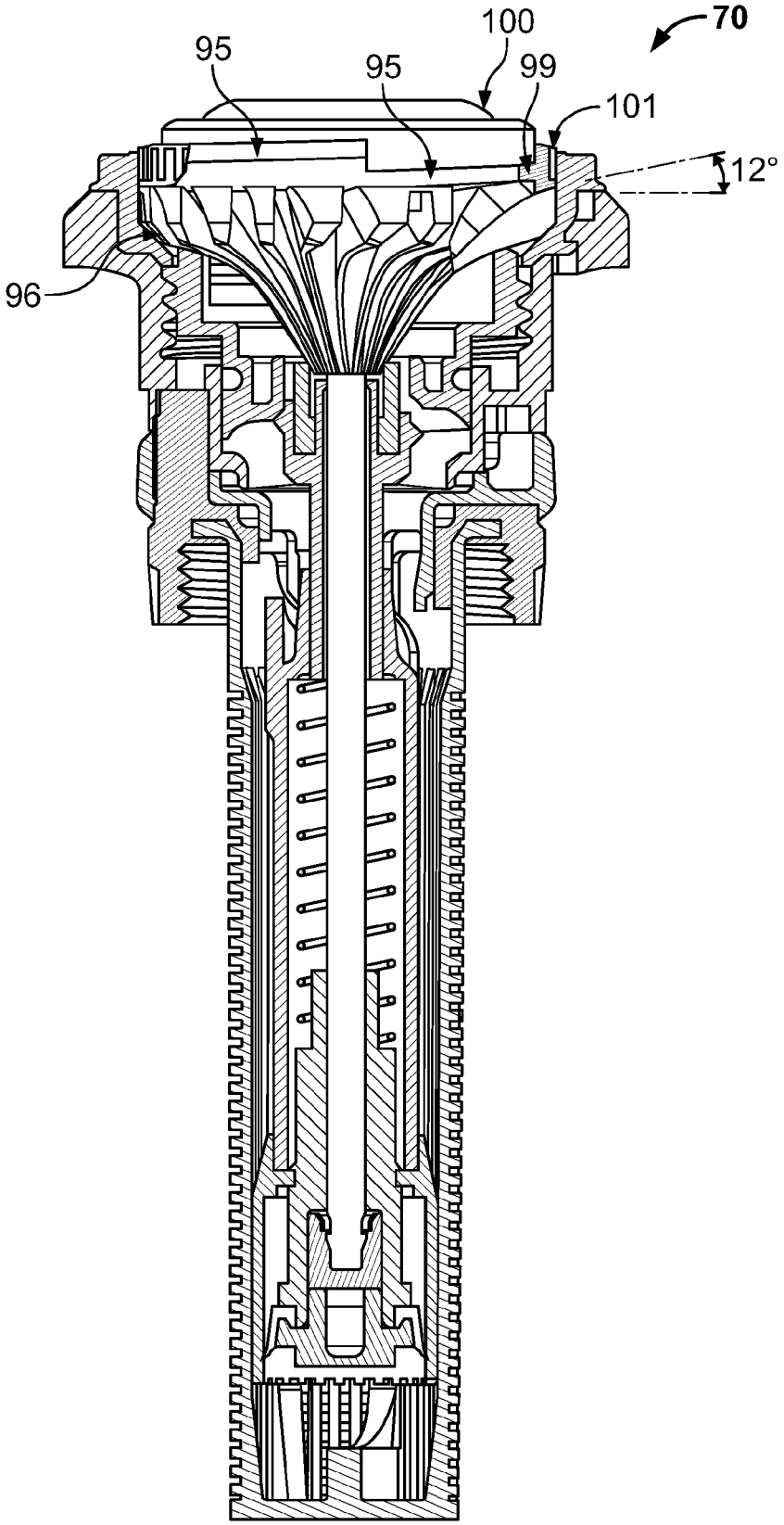
FIG. 8 is the same cross section as FIG. 7 but with the stream exit elevation angle deflection ring rotated down to limit the maximum stream exit elevation angles to be only 12 degrees.

As shown in FIGS. 7 and 8, the nozzle assembly 70 has the rotating distributors assembly retracted into the nozzle assembly housing 111 by an actuation position assembly 112 which is spring loaded via the spring 110 downwardly and is pushed upward to the operating position as shown in FIGS. 9 and 10 by water pressure acting on the bottom of the actuation position assembly 112.

The sprinkler nozzle assembly 70 is attached to a sprinkler riser or pipe attachment to a supply of water for the sprinkler nozzle assembly. The pressurized water enters the sprinkler nozzle assembly 70 through an attached filter 140 and flows upwardly through the upstream flow range control adjustable opening 102 which can be manually adjusted outside circumferential ring 100 around the lower outside of the nozzle assembly 70.

The water then flows upwardly through an axially stepped settable arcuate valve 130 which is also manually adjustable by an outside top mounted ring 91 that is rotationally coupled to the rotationally and axial movable valve member 115 which controls the arc of coverage around the sprinkler nozzle assembly 70 to the arcuate nozzle 130 which determines the circumferential arc of cover for discharging water 2 as shown at 73 onto the under side of the rotating distributor 111.

The rotating distributor 100 shown in the sprinkler nozzle assembly cross sectional view of FIG. 7 includes an additional ring around the outside circumference which is also rotational adjustable from the top of the outside nozzle assembly 70 by ring 101.

The ring 101 is mounted by an inside diameter upwardly protruding spiraled ring 99 which is captured in stepped spiral groove 95 and by lower side stepped and spiraled retaining ring 94, as better shown in FIG. 8.

As this stream elevation control ring is rotated by pressing down on the rotating distributor 100 which cause it to engage ring 96 as shown in FIG. 9 inside the nozzle assembly, it can protrude into the one of the rotating distributor flow channels which rotationally locking the rotating distributor which the ring is rotated to cause it to move upward or downward by the circumferentially stepped groove 95 around the configuration of rotating the distributor as shown in FIGS. 9, 10, 11 and 12 to allow controlling selected channels elevation angle from 30 degree down to 12 degrees for increasing or reducing range of coverage around the sprinkler or reducing the sensitivity of the rotating distributor nozzle assembly watering position to windy conditions.

In FIG. 9, the stream exit elevation control ring 101 is shown in a raised position, out of the streams to allow some stream elevation angles as high as 30 degrees in elevation for maximum hang in air. In FIG. 10, the stream exit elevation control ring 101 has been rotated relative to its rotating distributor 100 to the fully down position which limits all channel stream exit elevation angles to only 12 degrees as shown.

Figure 11:
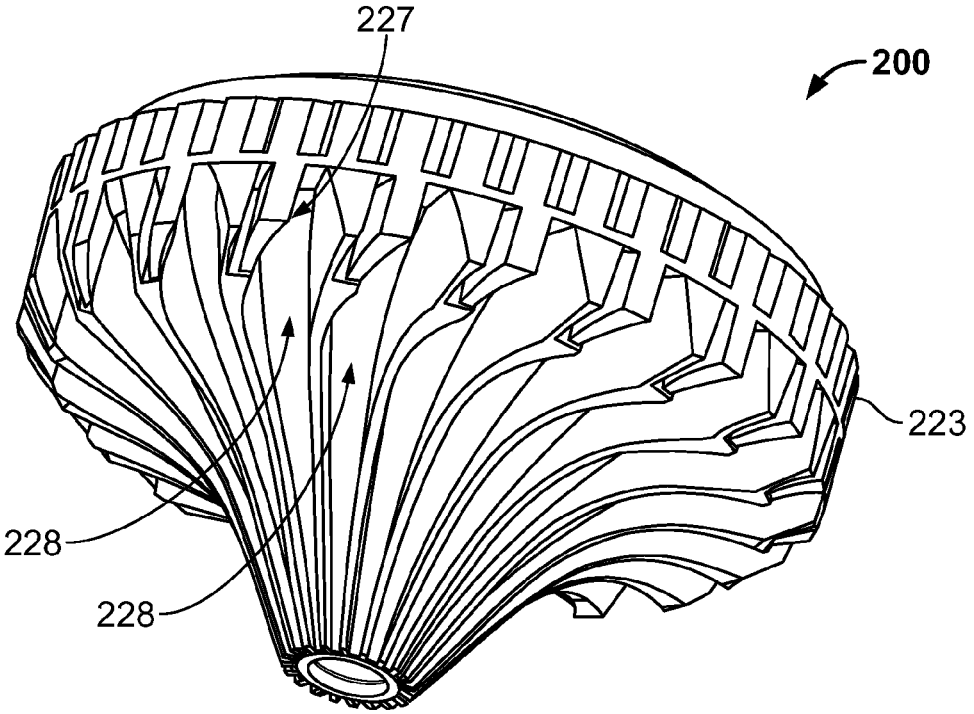
FIG. 11 shows a perspective view of a rotating distributor with an outside manually rotatable settable ring around the rotating distributor rotor outside the circumference settable to change selected channel horizontal exit kick angles for speed control of rotational control shown in a higher kick angle position.

In FIG. 11 a rotating distributor 200 is shown with an outside circumferential ring 223 with channel exit turning flow kick angle surfaces, or vanes, 227 which are shown turned into the exit channel flow from channel such as at 228.

Figure 12:
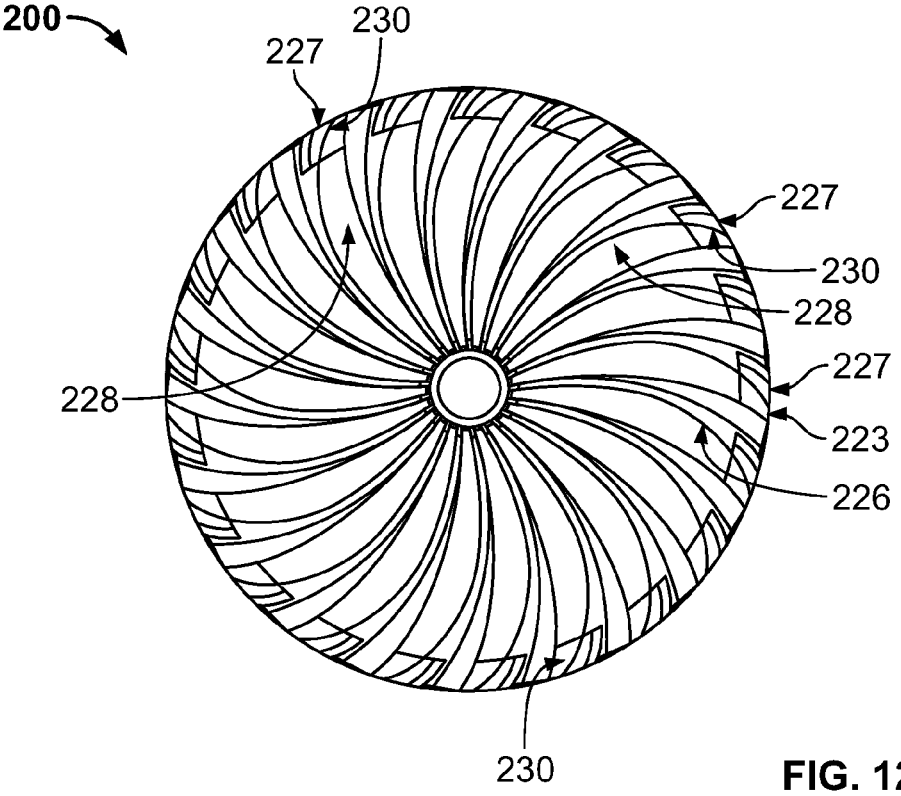
FIG. 12 shows a plan view of the under side of rotating distributor of FIG. 11 with the adjustable kick angle rotor speed control shown in a higher kick angle position.

FIG. 12 shows a bottom view of the distributor 200 where the ring channel kick vanes 227 can be seen adding additional partially tangential stream turning angle to the channel flows turning wall angle 226 as shown at 230.

Figure 13:
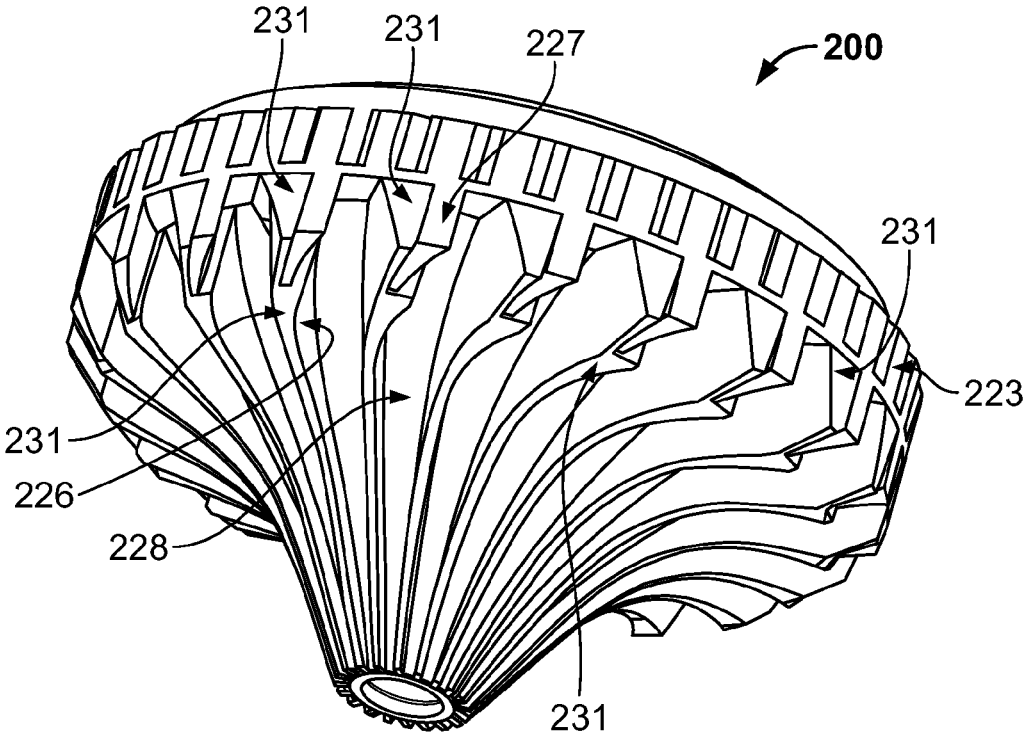
FIG. 13 shows a perspective view of the rotating distributor of FIG. 11 but with manually adjustable channel exit kick angle vanes moved out of the exit area of their respective flow channels.
Figure 14:
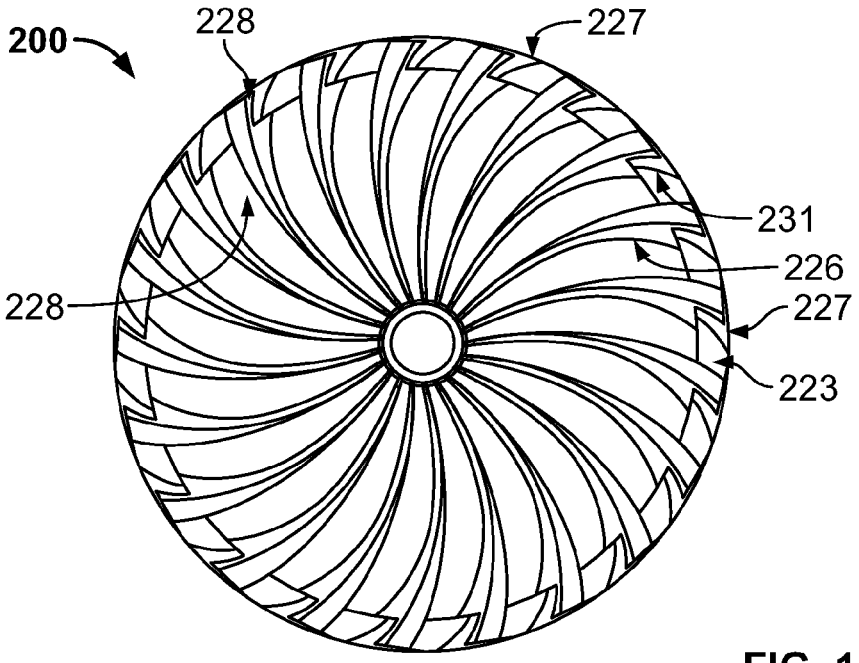
FIG. 14 shows a plan view of the under side of the rotating distributor of FIG. 13 with the adjustable kick angle vanes rotated out of the channel flow for normal speed operation.

In FIG. 13, the outside circumferential mounted ring 223 is shown rotated clockwise relative to the top of the rotating distributor 200 such that its flow kick vanes 227 are recessed in channel wall ribs 231 such as shown in FIG. 14.

FIG. 14 shows the bottom view of the kick vanes 227 being withdrawn into the covering width of channel wall ribs 231 out of the discharge from the stream channel 228.

Thus, the ring 223 may be used to increase or decrease a kick angle at the exit of selected channels to increase or decrease torque applied by the water flowing though the channels, and thus, provide for rotational speed control.

Although the present invention has been described in relation to particular embodiments thereof, many other variations and modifications and other uses will become apparent to those skilled in the art.

What is claimed is:

1. A rotating distributor for use in a rotary nozzle sprinkler comprising:

a conical body; and a plurality of grooves formed in a bottom surface of the conical body, each groove of the plurality of grooves extending from an inlet end thereof positioned adjacent to a center of the conical body to an outlet end thereof positioned adjacent to an outer periphery thereof; and a deflection adjustment ring mounted on the conical body including at least one kick vane extending inwardly into at least one groove of the plurality of grooves, the deflection adjustment ring movable from a first position wherein the kick vane extends into the groove and a second position wherein the kick vane is retracted out of the groove.

2. A rotating distributor comprising:

a conical body;

at least one groove formed in a bottom surface of the body; and a rotatable ring mounted on the conical body and configured such that rotation of the ring in a first direction moves at least one kick vane into the at least one groove to increase rotational driving torque on the rotating distributor and rotation of the ring in a second direction, opposite the first direction, moves the at least one kick vane out of the at least one groove to decrease rotational driving torque on the rotating distributor.

* * * * *